US007675396B2

(12) United States Patent
Liu et al.

(10) Patent No.: US 7,675,396 B2
(45) Date of Patent: Mar. 9, 2010

(54) INDUCTOR AND MANUFACTURE METHOD THEREOF

(75) Inventors: Chun-Tiao Liu, Hsin-Chu (TW); Yi-Min Huang, Hsin-Chu (TW); Roger Hsieh, Hsin-Chu (TW); Chin-Hsiung Liao, Hsin-Chu (TW)

(73) Assignee: Cyntec Co., Ltd., Hsin-Chu (TW)

( * ) Notice: Subject to any disclaimer, the term of this patent is extended or adjusted under 35 U.S.C. 154(b) by 0 days.

(21) Appl. No.: 12/014,590

(22) Filed: Jan. 15, 2008

(65) Prior Publication Data

US 2009/0085703 A1 Apr. 2, 2009

(30) Foreign Application Priority Data

Sep. 28, 2007 (TW) ..... 96136301 A

(51) Int. Cl.
*H01F 5/00* (2006.01)

(52) U.S. Cl. ..... 336/200

(58) Field of Classification Search ..... 336/65, 336/83, 200–208, 232, 233–234; 257/531
See application file for complete search history.

(56) References Cited

U.S. PATENT DOCUMENTS

| | | | | |
|---|---|---|---|---|
| 6,392,525 | B1 * | 5/2002 | Kato et al. | 336/233 |
| 7,339,451 | B2 | 3/2008 | Liu et al. | |
| 7,477,127 | B2 * | 1/2009 | Kamijima | 336/206 |

FOREIGN PATENT DOCUMENTS

| | | |
|---|---|---|
| TW | I256063 | 6/2006 |

* cited by examiner

*Primary Examiner*—Tuyen Nguyen
(74) *Attorney, Agent, or Firm*—Stout, Uxa, Buyan & Mullins, LLP

(57) ABSTRACT

An inductor comprises a coil, a non-ferrite layer, two electrodes, a first ferrite layer, and a second ferrite layer, where the coil is encapsulated by the non-ferrite layer having a first surface and a second surface opposite to the first surface, two electrodes coupled to the coil are respectively extended out from the non-ferrite layer for connecting a module, and the first ferrite layer and the second ferrite layer are respectively arranged adjacent to the first surface and the second surface of the non-ferrite layer.

5 Claims, 8 Drawing Sheets

INDUCTOR AND MANUFACTURE METHOD THEREOF

FIELD OF THE INVENTION

The present invention relates to a passive component, and more particularly, to an inductor and its manufacture method.

DESCRIPTION OF THE PRIOR ART

Inductors play important role in field of passive components. It can steady currents, match impedances, filter currents, store and release energy, harmonize pulses, and form bypass etc. Because electronic products are asked to minimize its size, the size of inductor is inevitably to minimize as well. Not only the size of inductor needs to be small enough to be mounted in a limited printed circuit board, but also the efficiency to match with the printed circuit board should be satisfied.

Generally, three factors are considered to choose an inductor: inductance, saturation current ($I_{sat}$), and DC resistance (DCR). Larger inductors usually have smaller DC resistance, better efficiency, and larger saturation current; smaller inductors have smaller saturation current, occupy less area of printed circuit board, but have larger DC resistance and thus lower the efficiency. In addition, a higher quality factor (Q factor) is preferable during the operating frequency band.

Generally an inductor comprises a magnetic core and a coil. Structures and materials of the magnetic core and the coil decide performance of the inductor. Materials of the magnetic core can be air, non-magnetic material, metal-magnetic material, and ferrite material. In the other hand, structures of inductors are usually designed to meet the surface mounting technology (SMT), or surface mounting device (SMD), as so to meet requires in size and conveniences in fabrication. The inductors designed for SMT can be divided into three types: multi-layer, winding, and thin film.

Referring to FIG. 1A, Taiwanese Patent No. I256063, it discloses an inductor and its manufacture method. An inductor 1 includes a metal wire that spirally winds to form a coil (not shown). The coil is put inside a mold (not shown), and then a magnetic powder, such as non-ferrite powder, is filled into the mold to surround the coil. A molding process is then performed to form a molding body 2 encompassing the coil. The coil includes two terminals respectively couple two lead frames as two electrodes 3 of the inductor 1. The surface of the molding body 2 includes two recesses 4. The electrodes 3 are bended and placed on the recesses 4 respectively, shown in FIG. 1B. The inductor 1 has features of small size and large saturation current ($I_{sat}$).

When match a module such as a DC/DC converter in printed circuit board, however, an inductor having better performance such as higher inductance, larger saturation current, smaller DC resistance, higher operating frequency, and better efficiency, is expected in condition that the minimized size should be kept as well.

SUMMARY OF THE INVENTION

An object of the present invention is to provide an inductor and a manufacture method to overcome problems of prior art.

According to the object, one embodiment of the present invention provides an inductor comprising a coil having two terminals; a non-ferrite layer encapsulating said coil, the non-ferrite layer having a first surface and a second surface opposite to the first surface; two electrodes respectively coupling the two terminals of the coil, each electrode having a part extending out from the non-ferrite layer; and a first ferrite layer arranged adjacent to the first surface of the non-ferrite layer.

The manufacture method for making the inductor comprises providing a coil, molding a non-ferrite layer having a predetermined shape such that the coil is embedded in the non-ferrite layer, and mounting at least one of ferrite layers on one of two opposite surfaces of the non-ferrite layer.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

DESCRIPTION OF THE PREFERRED EMBODIMENT

The detailed description of the present invention will be discussed in the following embodiments, which are not intended to limit the scope of the present invention, but can be adapted for other applications. While drawings are illustrated in details, it is appreciated that the scale of each component may not be expressly exactly.

Figure 2A:
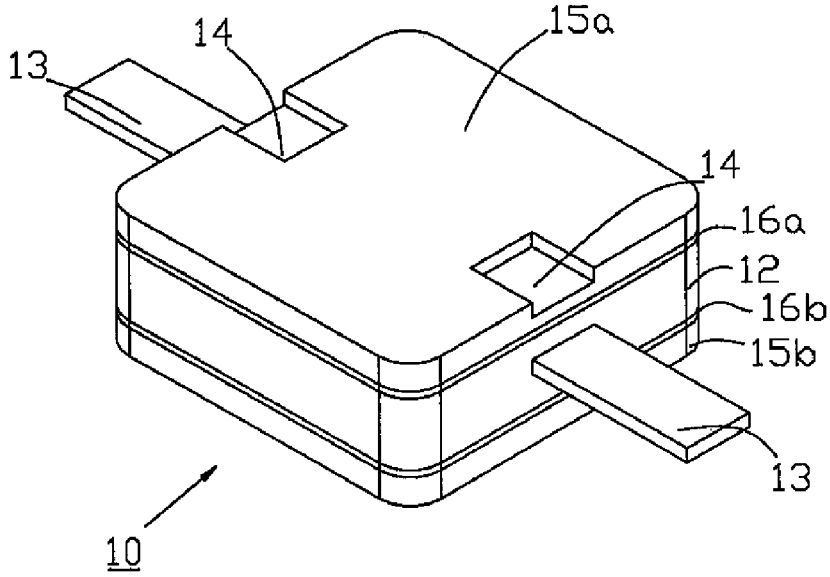
FIG. 2A illustrates an inductor according to one embodiment of the present invention.
Figure 2B:
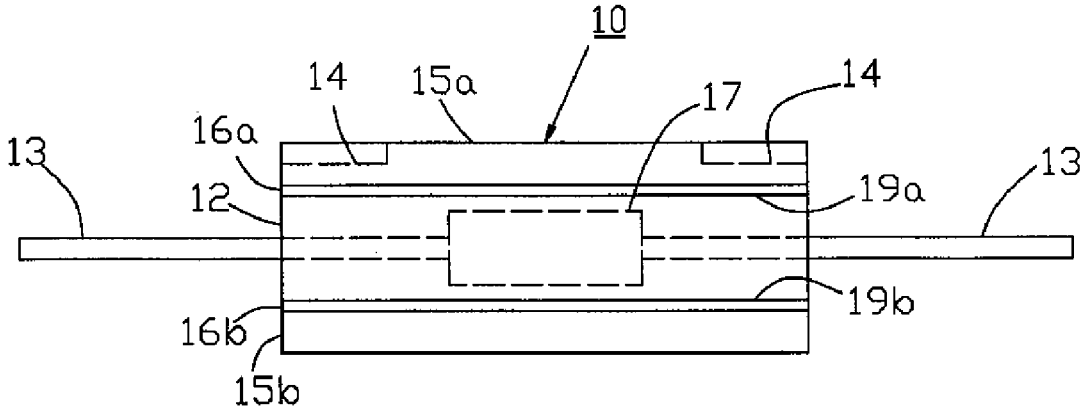
FIG. 2B is a side view of FIG. 2A.

Referring to FIGS. 2A and 2B, an inductor 10 according to one embodiment of the present invention exemplifies a power inductor (power choke) having high saturation current, but the inductor of the present invention can be other types. The inductor 10 comprises a coil 17, a first magnetic part 12, a second magnetic part 15*a*/15*b*, and two electrodes 13.

In this embodiment, the coil 17 has a winding structure formed by spirally winding a metal wire having an insulating wrap. In other embodiment, the structure of coil 17 can be other structures such as multi-layer or thin film. The metal wire can be made of gold, copper, or alloys.

In this embodiment, the first magnetic part comprises a non-ferrite layer 12. The coil 17 was embedded in the non-ferrite layer 12 that has a first surface 19*a* and a second surface 19*b* opposite to the first surface 19*a*. The permeability of non-ferrite layer 12 is called a first permeability. A part of the non-ferrite layer 12 is filled with the center of the coil 17 functions as magnetic core of the inductor 10, and the other part of non-ferrite layer 12 encapsulates the coil 17 to form a closed magnetic circuit. The non-ferrite layer 12 can be made of any metallic magnetic materials. For example, the metallic magnetic materials can be chosen from a group consisting of Fe, Fe—Cr—Si alloy, Fe—Si alloy, and combination thereof. In this embodiment, the non-ferrite layer 12 is formed by a compression-molding method to encapsulate the coil 17, but in other embodiments it can be formed by other methods such as injection-molding or heat-compression-molding. In addition, an additional magnetic core (not shown) may be placed in the center of coil 17 first, then using the compression-molding or injection-molding to form the non-ferrite layer 12 encapsulating the coil 17 and the additional magnetic core. The two electrodes 13 respectively couple to two terminals of the coil 17 and a part of each electrode 13 extends out of the non-ferrite layer 12. Each electrode 13 can be constructed by a lead frame connected to the terminal of the coil 17, or constructed by compressing the terminal of the coil 17. The two electrodes 13 are employed for electrically connect a module (not shown) of a printed circuit board.

Figure 3:
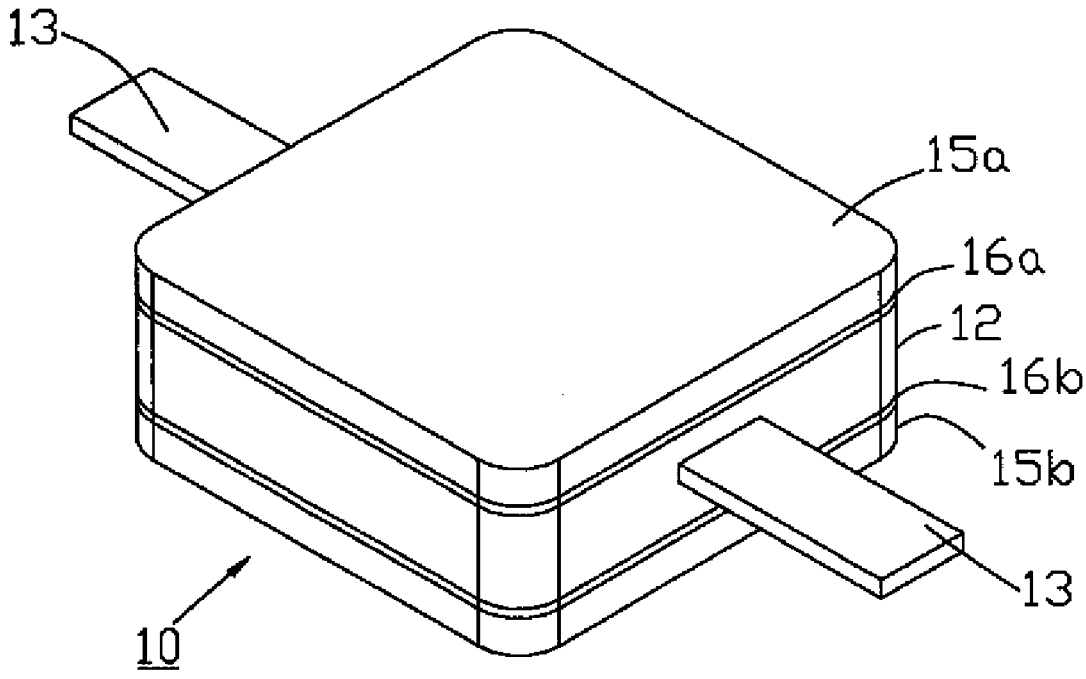
FIG. 3 illustrates an inductor according to another embodiment of the present invention.

The second magnetic part 15*a*/15*b* can be arranged adjacent to the first surface 19*a* or the second surface 19*b* or both the first and second surface 19*a*/19*b* of the first magnetic part (i.e. the non-ferrite layer 12). The permeability of the second magnetic part 15*a*/15*b* is called a second permeability. The second permeability is larger than the first permeability. In this preferred embodiment, the second magnetic part comprises a first ferrite layer 15*a* and a second ferrite layer 15*b*. The first ferrite layer 15*a* is arranged adjacent to the first surface 19*a* of the non-ferrite layer 12, and the second ferrite layer 15*b* is arranged adjacent to the second surface 19*b* of the non-ferrite layer 12. The permeability of the first ferrite layer 15*a* and the second ferrite layer 15*b* are the same called "the second permeability", but in other permeability they may have different permeability. The first ferrite layer 15*a* and the second ferrite layer 15*b* are made of a ferrite material. The ferrite material may be chosen from a group consisting of MnZn ferrite, NiZn ferrite, and combination thereof. The surface of first ferrite layer 15*a* or second ferrite layer 15*b*, remote from the non-ferrite layer 12, comprises two recesses 14. In this embodiment, the two recesses 14 are arranged at the surface of first ferrite layer 15*a*. Each of the two electrodes 13 extended out from the non-ferrite layer 12 is bent along the surface of non-ferrite layer 12 and first ferrite layer 15*a*, and then engages into one of the two recesses 14. As shown in FIG. 3, the first ferrite layer 15*a* may comprise free of recesses in other embodiments. In this situation, each of the two electrodes 13 may be bent to other locations of the inductor 10.

Figure 4A:
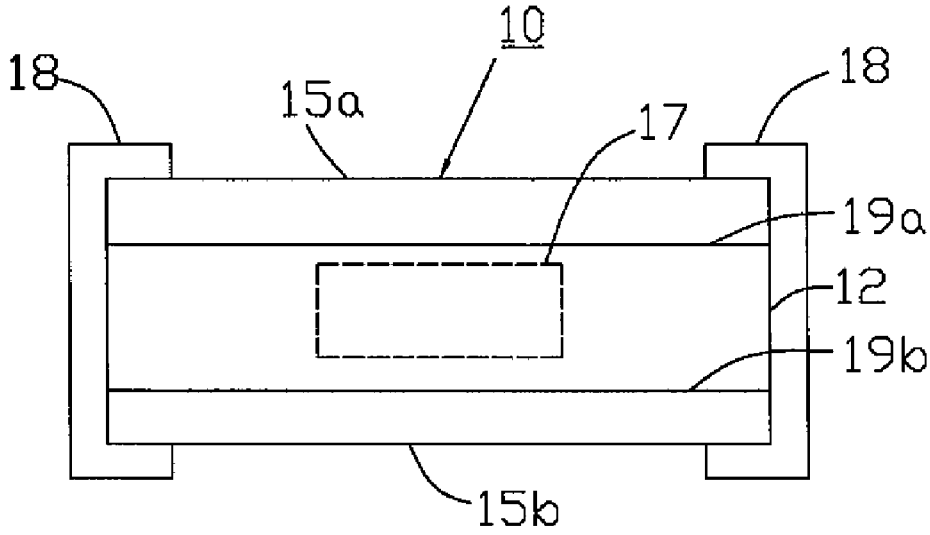
FIG. 4A and FIG. 4B illustrate a side view of an inductor according to another embodiment of the present invention.
Figure 4B:
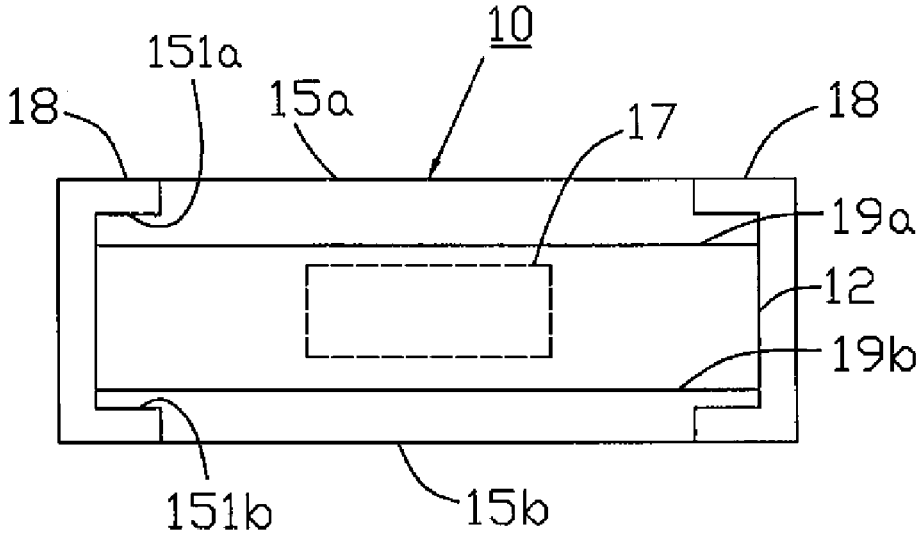

A non-magnetic layer 16*a*/16*b* such as mica, air, epoxy, or heat resistance tape can be arranged between the first magnetic part 12 and the second magnetic part 15*a*/15*b*. In this embodiment, the non-magnetic layer comprises a first adhesive layer 16*a* and a second adhesive layer 16*b*. The first adhesive layer 16*a* is directly disposed between the first surface 19*a* of the non-ferrite layer 12 and the first ferrite layer 15*a*. The second adhesive layer 16*b* is directly disposed between the second surface 19*b* of the non-ferrite layer 12 and the second ferrite layer 15*b*. The second magnetic part 15*a*/15*b* is mounted on the first magnetic part 12 via the first adhesive layer 16*a* and second adhesive layer 16*b*. The first adhesive layer 16*a* and second adhesive layer 16*b* comprise epoxy in this embodiment. However, the second magnetic part 15*a*/15*b* can be mounted on the first magnetic part 12 via other way. FIG. 4A and FIG. 4B show other embodiments to mount the first ferrite layer 15*a* and the second ferrite layer 15*b*. As shown in FIG. 4A, the inductor comprises free of the first and second adhesive layer 16*a*/16*b*, but comprises two additional U-shaped fixtures 18 to fix on the surface of first and second ferrite layer 15*a*/15*b*, hence the first ferrite layer 15*a* and second ferrite layer 15*b* can be respectively mounted on the first surface 19*a* and second surface 19*b* of the non-ferrite layer 12. For clarity, the drawing omits the electrodes 13 and recesses 14. In addition, as shown in FIG. 4B, the inductor comprises four step-shaped recesses 151*a*/151*b*, each one engaging one terminal of the two U-shaped fixtures 18, such that the height of inductor 10 will be the same as before.

The inductor 10 mentioned above are suitable for process of surface mounting technology, but the structure of inductor 10 is not limited. The structure of the inductor 10 is a cubic structure, but the structure of inductor 10 can be other structures such as rectangular, rectangular parallelepiped, cylinder, ellipsoid, and the like.

The non-ferrite material features in lower permeability, such that a required higher saturation current and an un-required higher DC resistance are expected. The ferrite material features in higher permeability, such that a required lower DC resistance and an un-required lower saturation current are expected. Some module such as a DC/DC converter needs an inductor that features in larger inductance, higher saturation current, lower DC resistance, higher operating frequency, and better efficiency, or needs an inductor features in higher inductance when current are heavy loaded and features in lower inductance when current is light loaded. In the prior art of this field, neither the non-ferrite material nor the ferrite material be merely used can satisfy the requirement. The present invention employs the ferrite layer 15*a*/15*b* to replace part of the non-ferrite layer 12, such that the inductance is higher and DC resistance is lower than the inductor that is wholly constructed by a non-ferrite material, and thus the structure of present invention can raise the efficiency. In addition, because the inductance of the inductor 10 are higher than that of prior art, we can make the inductance of the inductor 10 same as before by reducing numbers of turns of the coil 17. Since the numbers of turns of the coil 17 can be reduced, the DC resistance can be decreased, and therefore can decrease the power loss and increase efficiency.

Moreover, when heavy loaded current inducting magnetic filed are transmitted to the ferrite layer 15*a*/15*b*, the non-magnetic layer 16*a*/16*b* with moderate thickness can make the magnetic field to be acted at the ferrite and be limited at the non-saturated area of hysteresis curve (field strength H vs. magnetic flux density B), such that the inductor 10 can enhance a constant inductance and thus increase the saturation current. The present invention overcomes a problem of prior art that the inductance approaches to zero when current are heavy loaded due to the wholly ferrite material.

Figure 1A:
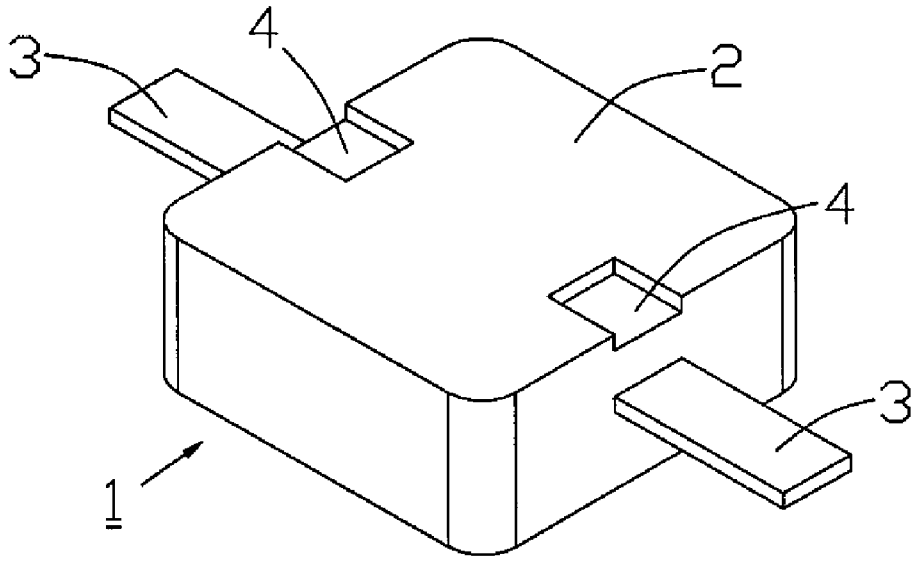
Fig. 1A (prior art)
FIG. 1A and FIG. 1B illustrate a conventional inductor.
Figure 1B:
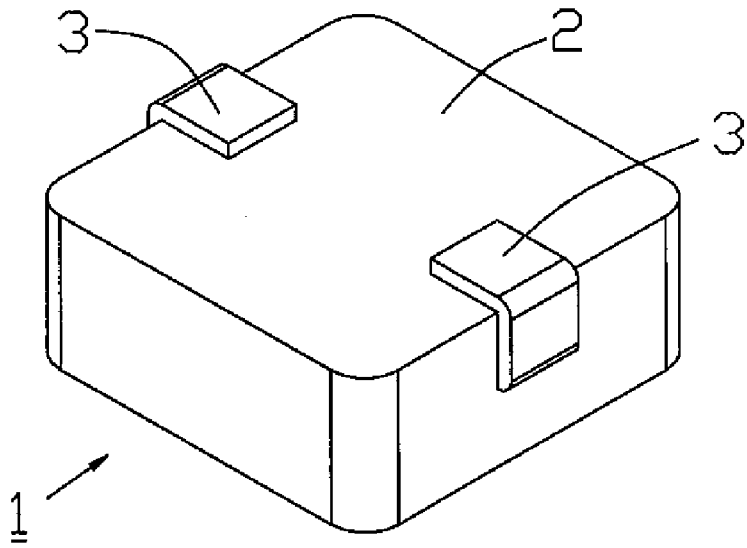
Fig. 1B (prior art)
Figure 5:
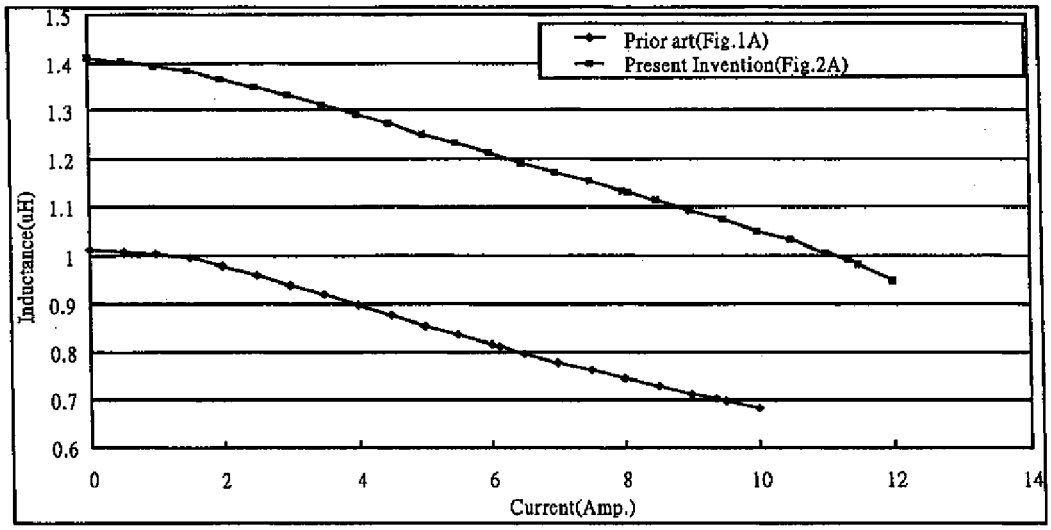
FIG. 5 and FIG. 6 show simulation results comparing one embodiment of the present invention and the conventional inductor.
Figure 6:
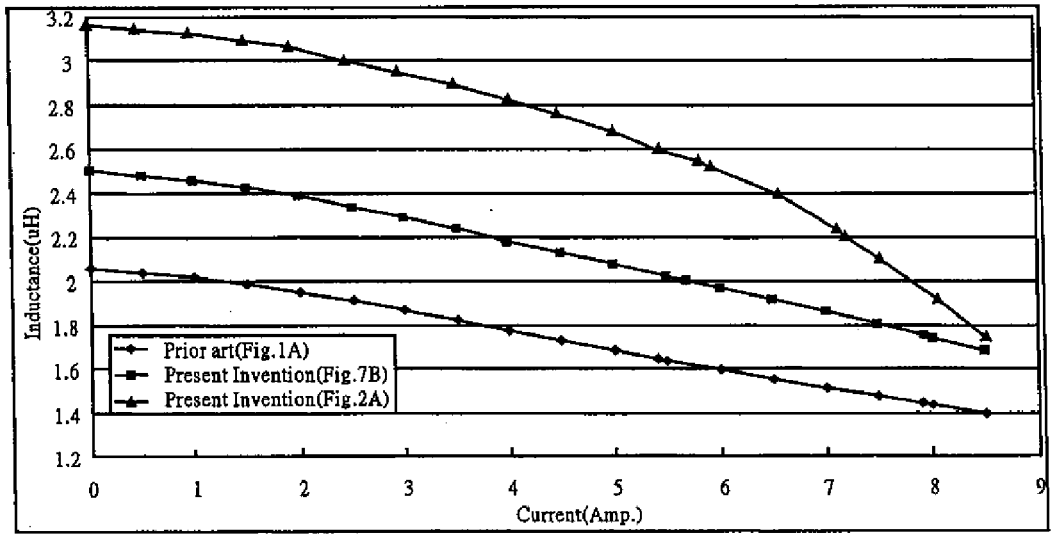

A simulation is performed to compare the inductor 1 shown in FIG. 1A (merely use non-ferrite material) and the inductor 10 shown in FIG. 2A; table 1, table 2, table 3, FIG. 5, and FIG. 6 show the result.

TABLE 1

| | Inductance (μH) | Saturation current at −20% (A) | DC resistance (mΩ) |
|---|---|---|---|
| Prior art | 1.0126 | 6.12 | 19.5 |
| Present invention | 1.4116 | 8.075 | 18.8 |

Note:
to exemplify, the non-magnetic layer is heat resistance tape having a thickness of 250 μm, and each ferrite layer has a thickness of 0.4 mm.

TABLE 2

| | Inductance (μH) | Saturation current at −20% (A) |
|---|---|---|
| Prior art | 1.9524 | 5.333 |
| Present invention | 2.9375 | 6.143 |

Note:
to exemplify, the non-magnetic layer is heat resistance tape having a thickness of 125 μm, and each ferrite layer has a thickness of 0.4 mm.

TABLE 3

| | Inductance (μH) | Saturation current at −20% (A) |
|---|---|---|
| Prior art | 2.0578 | 5.403 |
| Present invention | 3.1685 | 5.843 |

Note:
to exemplify, the non-magnetic layer is heat resistance tape, having a thickness of 125 μm, each ferrite layer has a thickness of 0.4 mm, the permeability of the ferrite layer is 400, and the permeability of the non-ferrite layer 12 is 30.

From the simulating results, the inductor 10 of the present invention has higher inductance and higher saturation current than the prior art. More, referring to FIG. 5 corresponding table 1 and FIG. 6 corresponding table 3, the curve of the present invention is nearly parallel to the cure of prior art, and the curve of the present invention is shifted upwardly compared to the curve of prior art, that imply the inductor 10 of present invention having better performance than the prior art.

Figure 7A:
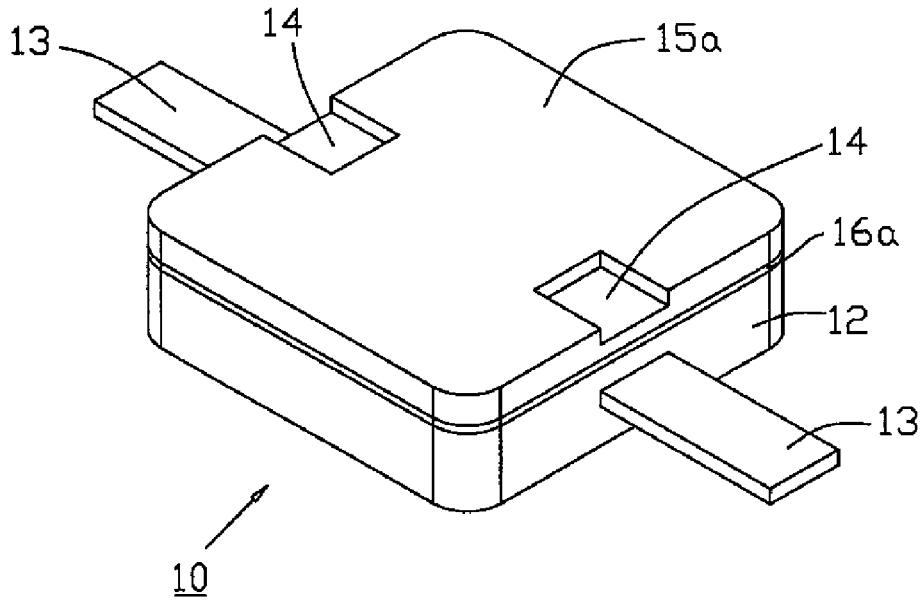
FIG. 7A and FIG. 7B illustrate an inductor according to another embodiment of the present invention.
Figure 7B:
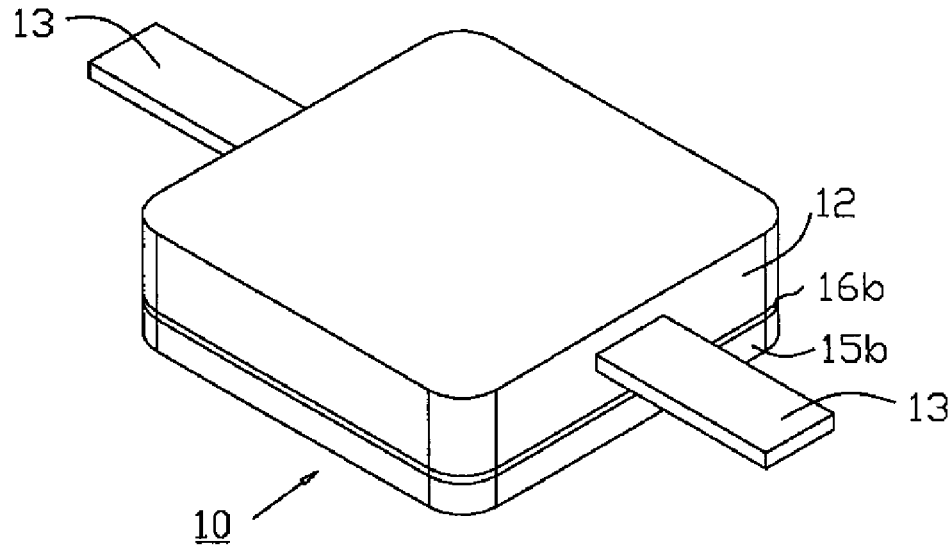

Another result simulating the embodiment of FIG. 7A or FIG. 7B is shown in table 4 and table 5.

TABLE 4

| | Inductance (μH) | Saturation current at −20% (A) |
|---|---|---|
| Prior art | 1.9524 | 5.333 |
| FIG. 7A | 2.317 | 5.232 |
| FIG. 7B | 2.3355 | 5.569 |

Note:
to exemplify, the non-magnetic layer is heat resistance tape having a thickness of 125 μm, and each ferrite layer has a thickness of 0.4 mm.

TABLE 5

| | Inductance (μH) | Saturation current at −20% (A) |
|---|---|---|
| Prior art | 2.0578 | 5.403 |
| FIG. 7B | 2.5 | 5.685 |

Note:
to exemplify, the non-magnetic layer is heat resistance tape, thickness, 125 μm, the ferrite layer has the thickness of 0.4 mm and the permeability of 400, and the permeability of the non-ferrite layer is 30.

From the simulating results, the inductor 10 of the present invention has higher inductance and higher saturation current than the prior art. More, referring to FIG. 6 corresponding table 5, the curve of the present invention is nearly parallel to the curve of the prior art and is shifted upwardly compared to the curve of the prior art, that imply the inductor of present invention having better performance than the prior art.

Figure 9:
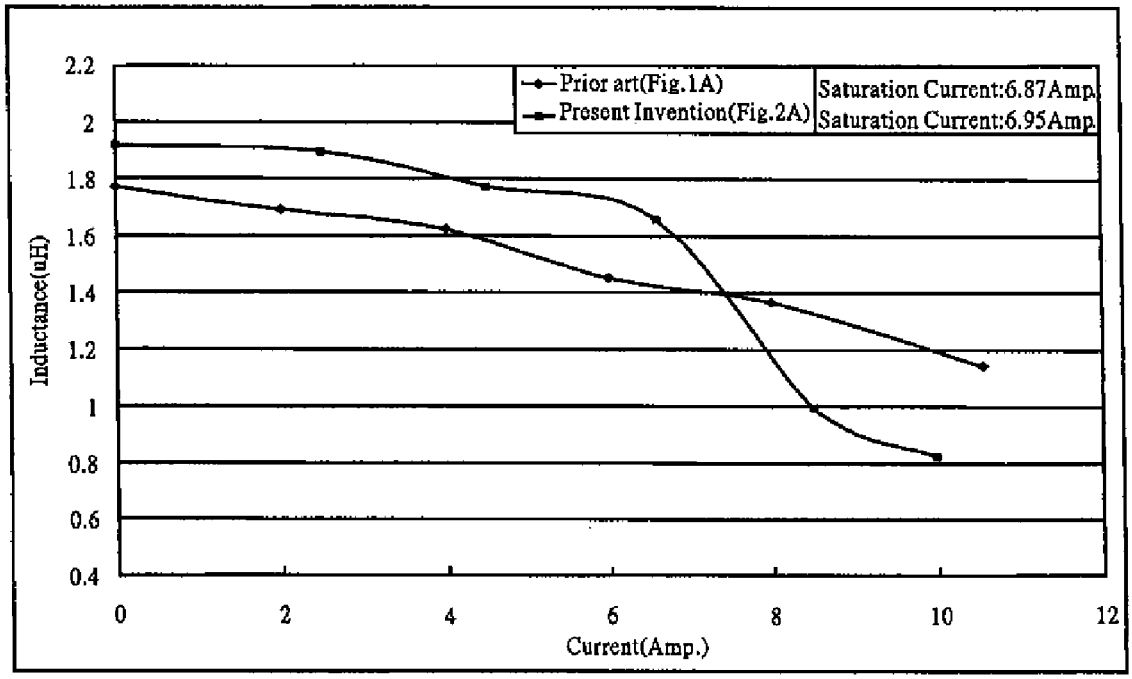
FIG. 9 shows another simulation result comparing another embodiment of the present invention and the conventional inductor.

Another simulation is performed to compare the inductor 1 shown in FIG. 1A (merely use non-ferrite material) and the inductor 10 shown in FIG. 2A, in condition that both inductors have the same thickness and same numbers of turns of coil, and to exemplify, each non-magnetic layer has thickness of 100 μm; each ferrite layer has thickness of 0.225 mm. FIG. 9 shows the comparing result. It can be recognized from FIG. 9 that the present invention has higher inductance and higher saturation current than the prior art that the inductor is merely constructed by the non-ferrite material.

Figure 8:
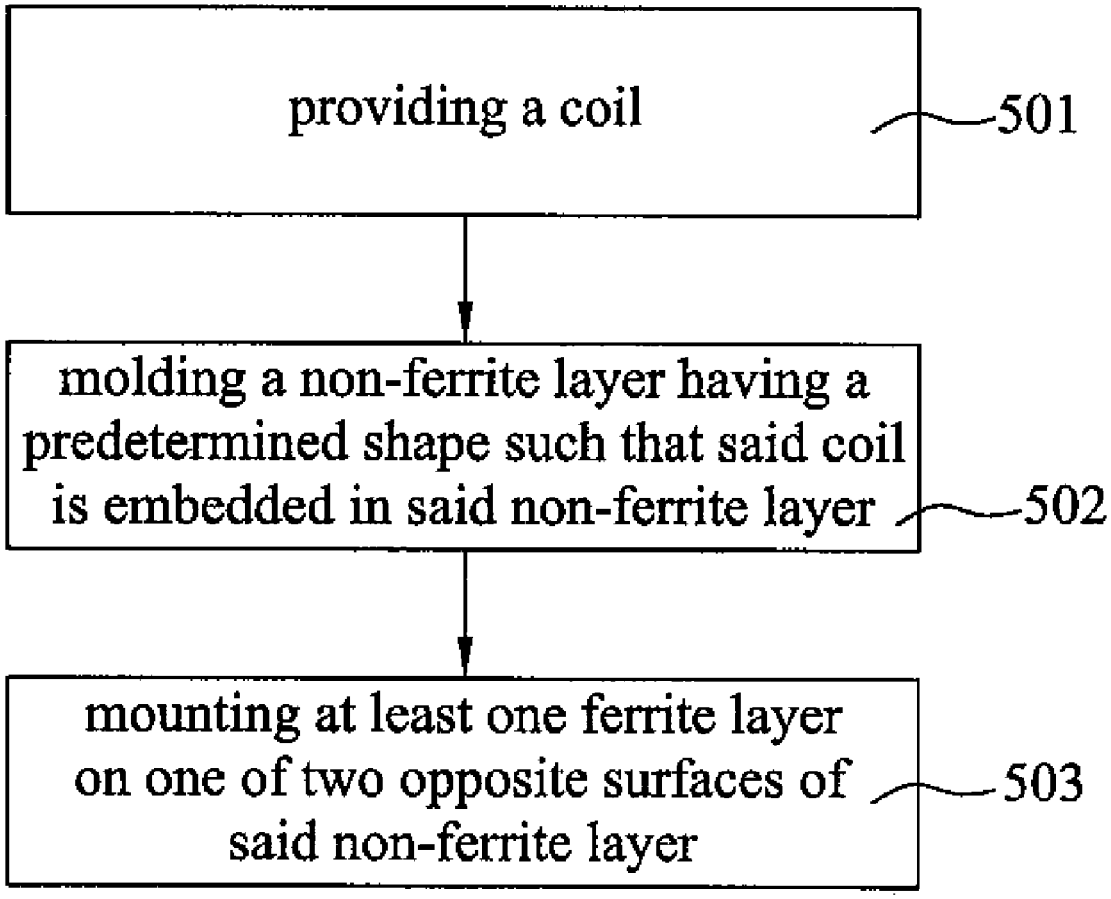
FIG. 8 shows a manufacture method of an inductor according to one embodiment of the present invention.

FIG. 8 shows a manufacture method according to one embodiment of the present invention. The manufacture method comprises providing a coil 17 (step 501), molding a non-ferrite layer 12 having a predetermined shape such that the coil is embedded in the non-ferrite layer (step 502), and mounting at least one of ferrite layers on one of two opposite surfaces of the non-ferrite layer 12 (step 503).

In step 502 of this preferred embodiment, a compression molding is employed to molding the non-ferrite layer 12; however, other methods may be used in other embodiments. In addition, step 502 further comprises placing the coil 17 into a mold (not shown), extending out two terminals of said coil 17 to form two electrodes 13, filling the mold with magnetic non-ferrite powder to encapsulate the coil 17, and proceeding a molding process to make the non-ferrite powder forming the non-ferrite layer 12 having the predetermined shape. In step 503 of this embodiment, an adhesive is employed to mount the ferrite layer on the surface of the non-ferrite layer. The ferrite layer comprises a first ferrite layer 15*a* or a second ferrite layer 15*b* or both. The adhesive comprises a first adhesive layer 16*a* or a second adhesive layer 16*b* or both. The adhesive layer can be omitted in other embodiments. In this situation, a U-shaped fixture 18 may be employed for this job.

Although specific embodiments have been illustrated and described, it will be appreciated by those skilled in the art that various modifications may be made without departing from the scope of the present invention, which is intended to be limited solely by the appended claims.

What is claimed is:

1. An inductor, comprising:

a coil having two terminals;

a non-ferrite layer encapsulating said coil, said non-ferrite layer having a first surface and a second surface opposite to said first surface;

two electrodes respectively coupling said two terminals of said coil, each electrode having a part extending out from said non-ferrite layer;

a first ferrite layer arranged adjacent to said first surface of said non-ferrite layer;

a second ferrite layer arranged adjacent to said second surface of said non-ferrite layer; and a first adhesive layer and a second adhesive layer, said first adhesive layer being directly disposed between said first surface of said non-ferrite layer and said first ferrite layer, and said second adhesive layer being directly disposed between said second surface of said non-ferrite layer and said second ferrite layer.

2. The inductor according to claim 1, wherein each of said adhesive layers is a non-magnetic layer.

3. The inductor according to claim 2, wherein said non-magnetic layer is made of mica, air, epoxy, or heat resistance tape.

4. The inductor according to claim 1, wherein said non-ferrite layer has a first permeability and said first ferrite layer has a second permeability larger than said first permeability.

5. The inductor according to claim 1, wherein said first ferrite layer is made from material selecting from a group consisting of MnZn ferrite, NiZn ferrite, and combination thereof, and said non-ferrite layer is made from material selecting from a group consisting of Fe, Fe-Cr-Si alloy, Fe-Si alloy, and combination thereof.

* * * * *